US006516727B2

(12) United States Patent
Kraft

(10) Patent No.: US 6,516,727 B2
(45) Date of Patent: Feb. 11, 2003

(54) HIGH CAPACITY MULTIPLE-STAGE RAILWAY SWITCHING YARD

(76) Inventor: Edwin R. Kraft, 512 Partridge Way, Frederick, MD (US) 21703

( * ) Notice: Subject to any disclaimer, the term of this patent is extended or adjusted under 35 U.S.C. 154(b) by 45 days.

(21) Appl. No.: 09/917,636

(22) Filed: Jul. 31, 2001

(65) Prior Publication Data

US 2002/0096081 A1 Jul. 25, 2002

Related U.S. Application Data

(63) Continuation-in-part of application No. 09/716,300, filed on Nov. 21, 2000.

(51) Int. Cl.[7] ..... B61B 1/00
(52) U.S. Cl. ..... 104/26.1; 246/167 R; 246/182 AA
(58) Field of Search ..... 104/26.1, 26.2, 104/162; 340/536, 933; 246/1 C, 167 R, 182 AA

(56) References Cited

U.S. PATENT DOCUMENTS

| | | | | |
|---|---|---|---|---|
| 1,825,415 A | | 9/1931 | Overmiller | |
| 2,976,817 A | * | 3/1961 | Stapp | 104/26.1 |
| 3,598,990 A | * | 8/1971 | Convey | 246/182 AA |
| 3,727,559 A | * | 4/1973 | McCune et al. | 104/26.1 |
| 3,861,316 A | * | 1/1975 | Yamazaki et al. | 104/26.2 |
| 3,865,042 A | * | 2/1975 | DePaola et al. | 104/26.1 |
| 3,889,603 A | * | 6/1975 | Harada | 104/26.1 |
| 4,034,677 A | * | 7/1977 | Frank | 104/162 |
| 4,174,820 A | | 11/1979 | Kempa | |
| 4,354,792 A | | 10/1982 | Cornish | |
| 4,480,723 A | | 11/1984 | Ingvast et al. | |
| 4,610,206 A | * | 9/1986 | Kubala et al. | 104/26.1 |
| 4,689,602 A | * | 8/1987 | Morihara et al. | 246/1 C |
| 4,766,815 A | | 8/1988 | Chongben et al. | |
| 4,883,245 A | * | 11/1989 | Erickson, Jr. | 104/307 |
| 4,926,755 A | | 5/1990 | Seiford, Sr. | |
| 5,092,248 A | | 3/1992 | Parry | |
| 5,388,525 A | | 2/1995 | Bodkin | |
| 5,623,413 A | * | 4/1997 | Matheson et al. | 104/307 |
| 5,676,337 A | | 10/1997 | Giras et al. | |
| 5,777,547 A | * | 7/1998 | Waldrop | 246/167 R |
| 5,986,579 A | * | 11/1999 | Halvorson | 104/88.03 |

OTHER PUBLICATIONS

Schlenker, M.A. (1995) Improving Railroad Performance Using Advanced Service Design Techniques: Analyzing the Operating Plan at CSX Transportation, May 1995, pp. 83–110.

* cited by examiner

*Primary Examiner*—S. Joseph Morano
*Assistant Examiner*—Lars A. Olson
(74) *Attorney, Agent, or Firm*—Donald A. Kettlestrings

(57) ABSTRACT

A high capacity, multiple-stage railway car switching yard connects together two or more subyards. Each subyard has a fully open arrival/departure end and may have a continuously descending gradient throughout the entire length of its classification tracks. The subyards are positioned opposite one another, so classification tracks of one subyard can serve as receiving tracks for another subyard. Escape tracks are interconnected between the two subyards to provide a higher capacity and more efficiency and flexibility than a single yard by itself.

5 Claims, 3 Drawing Sheets

HIGH CAPACITY MULTIPLE-STAGE RAILWAY SWITCHING YARD

CROSS-REFERENCE TO RELATED APPLICATIONS

This application is a continuation-in-part of application Ser. No. 09/716,300, filed Nov. 21, 2000 for Priority Car Sorting In Railroad Classification Yards Using a Continuous Multi-Stage Method.

FIELD OF THE INVENTION

This invention relates to railroads, particularly to methods of sorting cars in railroad yards.

DESCRIPTION OF THE RELATED ART

Copending utility patent application Priority Car Soiling In Railroad Classification Yards Using a Continuous Multi-Stage Method by Edwin R. Kraft, Ser. No. 09/716,300 (hereinafter referred to as the "parent application") describes new methods of multiple stage sorting in railroad classification yards. It also suggests several new yard designs to maximize the effectiveness of those methods. An extensive review of prior art is also included in the parent application. Further refinements to those operating methods and yard designs are disclosed herein.

Copending U.S. application Ser. No. 09/716,300 is incorporated by reference into this application, as provided by Manual of Patent Examining Procedure, Section 608.01(p). However, some repetition of material already covered in the parent application is necessary. In cases where drawing figures or tables from the parent application are referenced, they keep their same figure numbers (1–22), labels and reference numbers herein. Therefore, any repetitive material which does need to be included herein can easily be identified and cross referenced with the parent application.

Prior art designs for large railway classification yards dedicate specific tracks to distinct functions of receiving inbound trains, classification (sorting) of cars, and to assembly of outbound trains. Cars always move in a predetermined sequence from the receiving yard through the classification yard, and finally into the departure yard. Hump yards are modeled after an assembly line. The problem is that it is a rigid Henry Ford, 1920's-style assembly line, rather than adapting yard design to current just-in-time manufacturing paradigms—which emphasize flexibility, short setup times and rapid response to changing and always unpredictable customer needs. This lack of flexibility inherent in current yard designs translates into an inability to:

(a) make connections as scheduled, (b) protect capacity on outbound trains needed for higher priority cars, (c) accommodate "block swapping" or (d) benefit from switching already done at a previous yard.

Accordingly, major changes in design philosophy are needed to make hump yards effective in today's truck-competitive environment. Currently, hump yards generally use single stage sorting, where each car is classified only once. Single stage sorting is very restrictive, since it limits the number of classifications or "blocks" that can be built to no more than the number of tracks in the yard, and once cars are classified, affords no "second chance" to adjust the arrangement of cars. Even if a yard is built with many short tracks, single stage yards often cannot create as many blocks as are needed. Since classification tracks are usually too short to assemble outbound trains, cars have to be pulled out of the opposite end of the yard, called the "trim" end and moved into a separate departure yard having longer tracks. Usually this "flat" switching operation, and not the sorting capacity of the hump, limits maximum throughput of the yard.

In a multiple stage yard, each car may be classified more than once allowing cars to be sorted into many more blocks (distinct classifications) than the number of tracks available. As shown in the parent application if classification tracks are of sufficient length, trains of more than one block can be built "ready to go" on a single track in proper order for departure, without needing flat switching at the trim end of the yard. The second sorting stage at the hump replaces flat switching for outbound train assembly, resulting in no net increase in switching workload.

Having eliminated the flat switching bottleneck at the "trim" end of the yard, the capacity of a multiple stage yard is clearly constrained by the hump processing rate. A high processing rate is needed since each car must be classified two or three times in a multiple stage yard, as compared to only once in a single stage yard. This need for high capacity has been recognized for a long time, in fact, a lack of sufficient capacity using traditional gravity sorting has been thought to render multiple stage switching infeasible. In The Folded Two Stage Railway Classification Yard, (hereinafter referred to as Davis, 1967) on p. 55 the two-fold yard was characterized as "a new concept in yard design. It may never have been proposed before because it would be inoperative using the sorting techniques presently employed by railroads. The yard uses neither an engine nor gravity to separate the cars." Instead, Davis proposed use of a mechanical car accelerator to boost sorting capacity.

Although some U.S. yards have classified over 3,000 cars per day across a single gravity hump, with the increasing weight and length of modern cars, yard capacity has been slowly reduced. A typical hump yard today classifies 2,000–2,500 cars per day. A multiple stage yard of the same capacity would need a humping capability of 5,000–7,500 cars per day. This invention shows how the capacity needed to enable practical multiple stage sorting can be attained within the proven capability of conventional gravity switching, without needing to resort to any exotic or untested mechanical devices for accelerating or controlling the speed of railcars.

Shortcomings of Previous Designs

FIG. 10 of the parent application shows a design for a multiple stage classification yard. This yard consists of a single body of long classification tracks 55, which should have a slight descending gradient throughout their entire length, so cars will roll all the way to the ends of the tracks. With such a gradient, car speed can be adequately controlled using only retarder units, avoiding the necessity for more expensive booster units. FIG. 22 of the parent application shows how "Dowty" car retarders may be distributed throughout the entire length of each track to maintain continuous speed control of cars, and to stop the cars upon reaching the end of each track.

The design of FIG. 10 of the parent application permits maximum flexibility in use of classification tracks for receiving inbound trains, sorting of cars and for final assembly of outbound trains. Cart roads 60 between every pair of tracks allow convenient access by mechanical personnel for performing car inspection and repairs, and for maintaining tracks, switches and car retarder systems.

Means for accelerating cars 90 into the classification tracks (generally assumed to be a gravity hump) are provided at one end of the yard. Switches at the opposite end of the yard, called the arrival/departure end 80, allow trains to arrive and depart the yard onto the mainline 30 without interfering with hump 90 activities. Flat switching can also be performed at the arrival/departure end 80, permitting "swapping" blocks of preclassified cars directly from one train to another, avoiding the need for those cars to be processed over the hump.

The main weakness of the yard shown in FIG. 10 of the parent application is that it only allows one train to be processed at a time. This severely constrains its capacity. FIGS. 14 and 15, also from the parent application, suggest placing a hump on both ends of the yard to increase its sorting capacity. However, such "double ended" designs can be problematical for the following reasons:

(a) It becomes necessary to coordinate processing activities of two humps at both ends of the yard, since cars cannot be safely humped into a track from both directions simultaneously.

(b) Double ended designs cause difficulties in establishing proper gradients throughout the length of the yard. Cars would tend to collect at the low point of the yard in the middle, rather than rolling all the way to the ends of the tracks. This problem could be overcome, at some cost, by employing booster units (an optional feature of the "Dowty" retarder system) to keep the cars rolling.

(c) Humps 90*a* and 90*b* on both ends of the yard block access to classification tracks 55 needed by arriving and departing trains, and also prevent flat switching. Although the lapped design as in FIG. 15 of the parent application partially addresses the problem, a fully open arrival/departure end 80 as shown in FIG. 10 of the parent application is even more desirable to minimize interference with hump 90 operations.

(d) Finally, sorting activity in a double-ended yard may become so intense as to render impractical the inspection and repair of cars while they lie in the classification tracks. This defeats one of the main benefits of multiple stage switching, which is the ability to effectively utilize car time waiting for connections to perform maintenance and other mechanical servicing activities.

BRIEF SUMMARY OF THE INVENTION

The high capacity multiple-stage yard of FIG. 1, which consists of two subyards, does not suffer the limitations associated with a double ended design. Each subyard has a fully open arrival/departure end, and may have a continuously descending gradient throughout the entire length of its classification tracks. The design of FIG. 10 in the parent application which is used as a template, can be replicated as many times as needed to attain the needed total capacity. The key to success of this design is positioning the subyards opposite one another, so classification tracks of one subyard can serve as receiving tracks for the other subyard. By interconnecting the escape tracks 10 between the two yards as shown in FIG. 1, the facility not only has higher capacity but even more efficiency and flexibility than a single yard by itself.

A very simple, but critical improvement shown in both FIGS. 1 and 3 is provision of a double hump lead track 40. By providing scizzors crossovers 140 at the hump crest, any classification track 55 can be reached from either hump lead track 40. (These are labeled 40*a*, 40*b*, 55*a*, 55*b*, 140*a* and 140*b* in FIG. 1 because those features are replicated in both subyards.) Although double hump leads with crossovers are often provided in single stage yards, they are of limited value since parallel hump operations frequently interfere with one another. In a single stage yard a second hump lead can be used to preposition trains for processing, but seldom can two humping operations proceed at once. But in a multiple stage yard during second stage sorting, cars are sorted into just a few tracks representing the outbound train(s) currently being assembled. If all these tracks are located on the same side of the yard, two hump operations can proceed concurrently without interference.

Since over half the hump processing time in a multiple stage yard is consumed by second stage sorting, dual hump leads can be of considerable value. In a multiple stage yard, dual leads are much more useful than in traditional single stage yards, since they can boost capacity by at least 50%.

By providing two subyards as shown in FIG. 1, capacity is further doubled, since operations in the two subyards do not interfere with one another. By providing four hump switching leads (as compared to only a single lead in the yard of FIG. 10 in the parent application) hump capacity is increased by a factor of at least three times. By comparison, using the triangular sorting pattern, each car must be sorted on the average between 2.5 and 3 times. Therefore, it should be apparent that the capacity of the yard of FIG. 1 will be comparable to that of a large conventional single stage yard. This is accomplished without requiring inordinately high hump processing rates or any unusual mechanical means for accelerating or regulating the speed of cars. This capacity is achievable using conventional, proven gravity switching methods, and assumes that each car will have to be classified up to three times before it finally departs the yard.

The preceding discussion shows how the required capacity increase can be achieved through physical design of the yard facility. However, capacity can be further increased and costs reduced even more by utilizing the special yard operating methods proposed here. The first method exploits specific features of the track configuration shown in FIG. 1. The second method relies on a system of partial preclassification of cars to eliminate the need for first stage sorting, which by itself can almost double yard capacity. That method can be utilized in the yard of FIG. 10 in the parent application as well. Each of these operating methods are detailed in the following sections.

Objects and Advantages

Several objects and advantages of the present invention are:

(a) As shown in FIG. 3, capacity can be increased by providing a double hump lead with scizzors crossovers instead of only a single switching lead across the hump. Using this second hump lead during second stage switching operations can boost capacity by at least 50%.

(b) By positioning two or more subyards opposite one another, interconnecting the escape tracks and providing crossover tracks in the classification yard as in FIG. 1, one subyard can receive trains for processing in the opposite subyard. This eliminates the need for one "pull back" move. With two subyards, operation as a "folded" yard also becomes possible. Provision of a second subyard (where each subyard has a double hump lead with scizzors crossovers) increases capacity by at least three times, as compared to the yard shown in FIG. 10 of the parent application.

(c) Cars can be partially preblocked at preceding yards to bypass the first stage sort. By enabling better utilization of the double hump lead as well as directly reducing the number of cars that have to be switched, partial preblocking can more than double the capacity of the yard. Implementing all three improvements at once, the capacity of the yard of FIG. 10 in the parent application can be increased by a factor of at least six times.

Still further objects and advantages will become apparent from consideration of the ensuing description and drawings.

BRIEF DESCRIPTION OF THE SEVERAL VIEWS OF THE DRAWINGS

In the drawings, closely related elements have the same number but different alphabetic suffixes.

DESCRIPTION OF THE INVENTION

Figure 1:
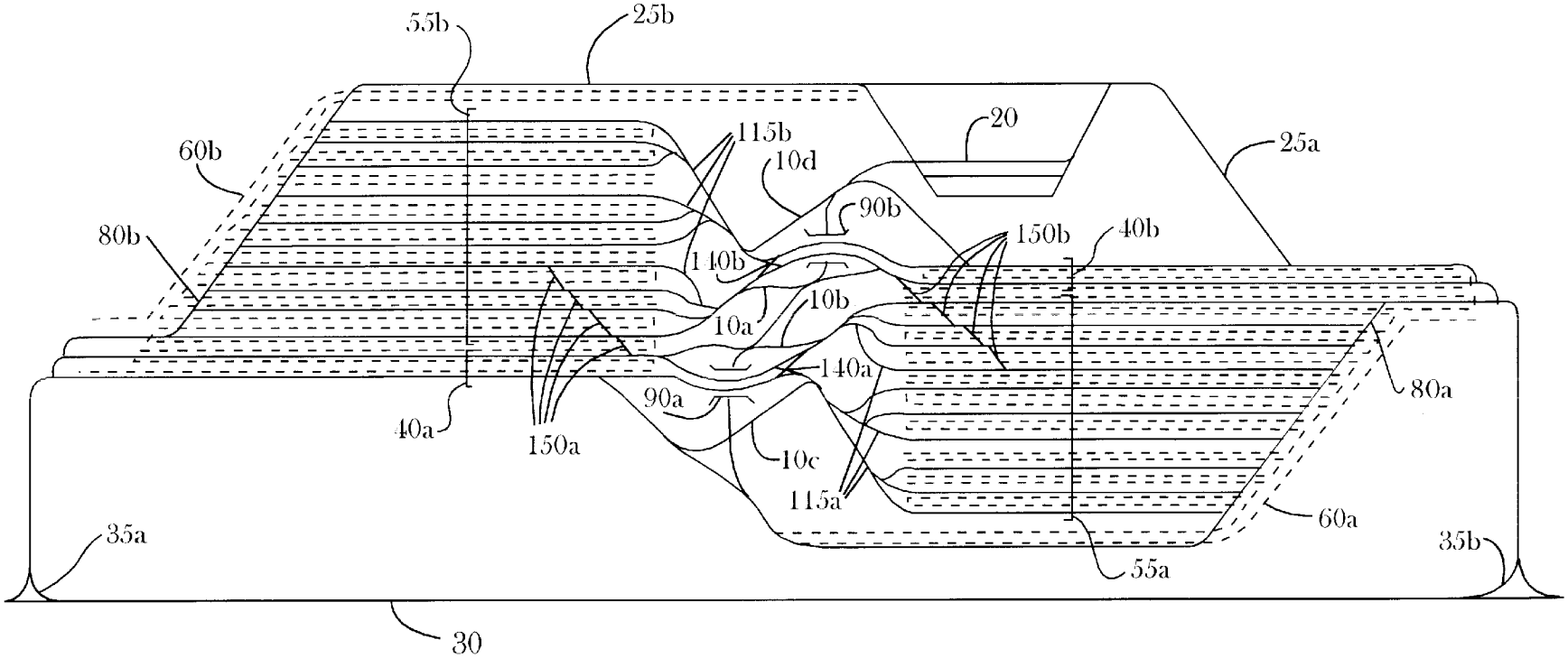
FIG. 1 shows a high capacity multiple stage switching yard having two subyards, with a total of four available switching leads.

| Reference Numerals In Drawings | |
|---|---|
| 10 | Hump Escape Track |
| 20 | Locomotive Servicing Facility |
| 25 | Running Track |
| 30 | Main Line Track |
| 35 | Wye Track |
| 40 | Hump Lead Track |
| 55 | Classification Tracks with Retarders |
| 60 | Cart Road between each track |
| 80 | Arrival/Departure end |
| 90 | Hump |
| 100 | Fastbound Receiving/ Westbound Departure Switches |
| 105 | Middle Tracks |
| 110 | Westbound Receiving/ Eastbound Departure Switches |
| 115 | Sorting Switches |
| 120 | Dowty retarder units |
| 125 | Rails |
| 140 | Scizzors Crossovers |
| 150 | Crossovers between Classification Tracks |

FIG. 1—Preferred Embodiment

The preferred embodiment for a railway classification yard consists of at least two subyards "a" and "b", as shown in FIG. 1, where each subyard is patterned after the yard of FIG. 10 in the parent application. Subyard "a" consists of a double lead track 40*a,* means for accelerating cars 90*a* (normally a gravity hump) connected by switches 115*a* to classification tracks with cart paths 55*a*. These classification tracks 55*a* are in turn connected to the mainline 30 by another set of switches, which comprise the arrival/departure end 80*a*. Subyard "b" consists of a second complete set of identical elements 40*b,* 90*b,* 115*b,* 55*b* and 80*b* oriented in the opposite direction, and positioned so the escape tracks 10 of the two yards are interconnected. The escape tracks 10 serve three main purposes:

(a) Escape tracks permit locomotives on arriving trains to move directly to the locomotive servicing facility 20, without interfering with sorting activities on either of the hump lead tracks 40.

(b) When a switching locomotive enters the classification tracks 55 to retrieve a cut of cars for second stage sorting, cars can be pulled back to the hump lead tracks 40 via escape tracks 10 bypassing the hump. These escape tracks provide a relatively straight and level route out of the classification tracks 55, enabling the pull back operation to be performed faster, with less interference to hump 90 activities, and causing less wear on retarder systems and switches 115 in the yard.

(c) Escape tracks also offer an alternative to using arrival/departure ends 80 for mainline trains arriving or departing the yard. However as discussed in the parent application, this use is undesirable, since it blocks access from the hump 90 to some outside classification tracks 55.

Each subyard may operate independently as a yard of FIG. 10, as described in the parent application. However by coordinating activities between two subyards, some operations can be performed that are not possible in a yard consisting of only a single body of tracks.

Receiving Trains in the Opposite Subyard

With provision of four humps in the high capacity yard, the bottleneck is no longer humping capacity, but rather the ability to continually feed cars to the humps as fast as they can be processed. The most time-consuming operation is the pull-back movement where a switch engine enters the classification tracks to retrieve its next cut of cars. If those cars are pulled back via escape tracks 10 then access from the hump to some outside yard tracks is blocked. If cars are pulled back via the hump, the hump is completely blocked. If the humps can be fed without having to pull cars back from classification tracks, capacity is increased since interference with hump operations is reduced, and cars can be fed on almost a continuous basis.

In the high capacity yard of FIG. 1, the need for pulling cars back can be reduced if arriving trains are received in the classification tracks of the opposite subyard. To do this, crossover tracks 150 are used to allow trains to be shoved from the classification tracks of one subyard directly to the hump of the other subyard. For example arriving trains may be received in classification tracks 55*a* of subyard a, and shoved through the crossovers 150*b* directly to hump 90*b* of subyard b. Only those classification tracks 55 having crossover tracks are accessible for this purpose. Rather than building a separate receiving yard, with the design of FIG. 1 classification tracks 55 can be flexibly used as receiving tracks when such receiving tracks are needed; and reused for classification or departure purposes at other times.

Another method for reducing pull-backs is operation as a two-stage folded yard. If cars in the first sorting stage are collected in the classification tracks 55 with crossovers 150, they can be humped directly back into the opposite subyard without having to pull them back. The two-stage folded yard, studied extensively by Davis (1967), is best suited for arithmetic rather than triangular sorting.

The differences between those two sorting methods are fully described in the parent application. However, the main benefit of arithmetic sorting (also called the "Sorting by block" method) is that it needs only two classifications per car, compared to triangular sorting which requires up to three classifications per car.

The major disadvantage of arithmetic sorting is that all needed yard tracks must first be cleared of other cars, and dedicated exclusively to this operation for an extended period of time. Track space needed to support arithmetic sorting may not always be readily available, which limits the potential applicability of this method. Still, use of arithmetic sorting instead of triangular sorting can reduce the number of cars needing to be switched, whenever circumstances permit its application.

Partial Preblocking of Cars to Bypass the First Stage Sort

Most current hump yards cannot benefit from preclassification work already done for them. This stems from inflexibility of their track design, and from limitations of their radar systems used to control conventional "clasp" car retarders. Reflecting the inflexible "assembly line" design philosophy used in most yards, no convenient way to move a preblocked group of cars directly from the receiving yard to the departure yard is provided. A special switch engine move is usually not considered worth the effort Cars humped in multiple do not accelerate the same as individual cars, so the radar system used to control the retarders has difficulty determining the force needed to adequately control car speed. Because of this limitation most yards cut off only one or a few cars at a time, even if all the cars are destined for the same track. Usually hump yards find it faster to process cars individually rather than flat switching across the hump.

Figure 3:
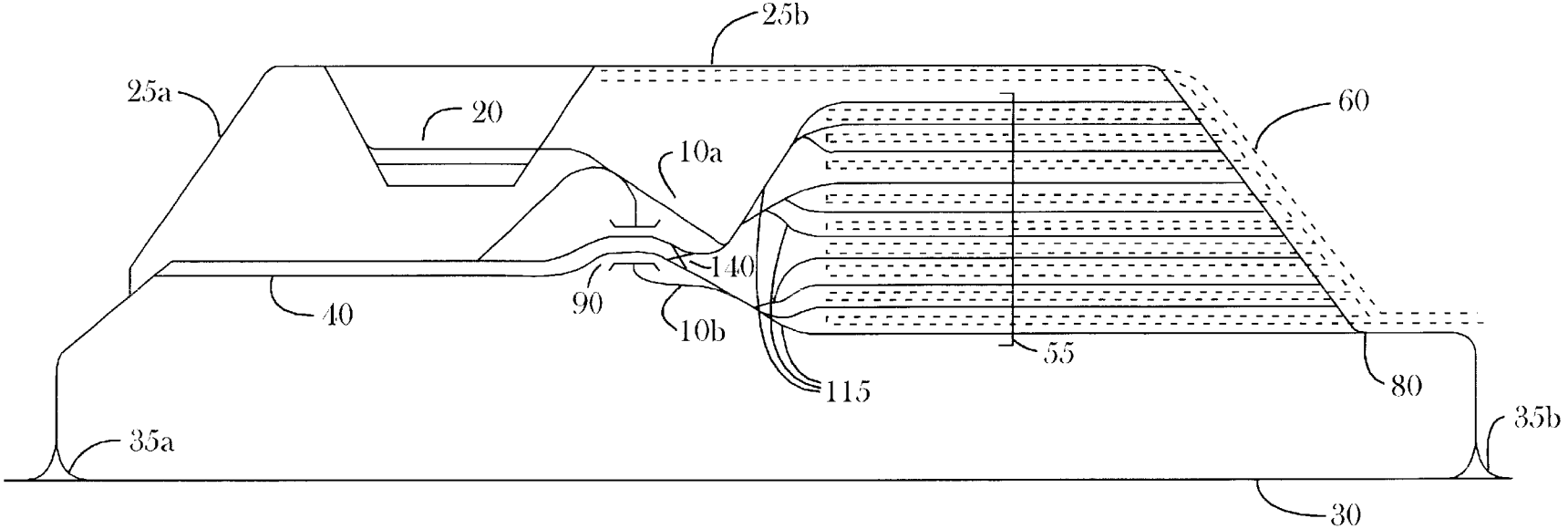
FIG. 3 shows the yard of FIG. 10 in the parent application, with addition of dual switching leads with scizzors crossovers across the hump.

The multiple stage yards of the parent application and of FIGS. 1 and 3 of this application do not suffer either of those limitations of prior art single stage yards. First, since classification, arrival and departure functions are all combined into the same set of tracks, it is easy to flat switch preclassified blocks of cars at the arrival/departure end, eliminating the need for those cars to pass over the hump. Second, since the yard utilizes distributed (e.g. "Dowty") retarders instead of radar-controlled clasp retarders, cars can be humped in multiple without difficulty.

M. A. Schlenker, in his 1995 MIT Master's thesis. *Improving Railroad Performance Using Advanced Service Design Techniques: Analyzing the Operating Plan at CSX Transportation* (hereinafter referred to as Schlenker, 1995) on pp. 83–110 proposed a new concept, called "Tandem Humping" in which the two stages of arithmetic sorting would be performed in separate hump yards. While the method of partial preclassification disclosed herein may resemble tandem humping, there are also a number of important differences as shown in Table 1. By taking advantage of yard facilities specifically designed to support the needed switching operations, partial preclassification avoids many limitations of tandem humping, and offers a number of improvements over that prior art method.

TABLE 1

Comparison of Tandem Humping to Partial Preclassification

| Functionality | Tandem Humping | Partial Preclassification |
|---|---|---|
| Operational Scope | One Yard to One Yard only | Many Yards to Many Yards-Any yard in the network may participate with no restrictions on network topology |
| Motivation | Avoid Internal Processing Constraint in Hump Yards designed for Conventional Single Stage Processing | Reduce Total Handlings and Increase Capacity in a special purpose yard specifically designed for multiple stage sorting. |
| Size of Blocks Created | Very fine blocks of 2–3 cars, perhaps too small for efficient downstream processing | Regularly-sized blocks of 15+ cars each |
| Sorting Pattern Used | Arithmetic | Continuous Triangular |
| Inbound Trains Received | on Receiving Tracks, trains must be humped in the second stage yard exactly as they are received from the first yard. | on Classification Tracks, cars from other trains may be added before second stage sorting is performed. |
| Limitations on the Processing Order of Arriving Trains | Arriving trains must be processed in the correct order or cars will be in the wrong sequence. | No restriction on the order in which arriving trains may be processed prior to the beginning of the second stage sort. |
| Limitations on Adding Cars | Cars cannot be included in the matrix at the second yard unless they have passed through the first yard. | Cars can be added anytime to the matrix in the second yard, by either flat switching or first stage processing at the hump. |

Traditional methods of preclassification, called "block swapping" call for a preceding yard to build a block which would normally only be built at the central hub yard. When such preclassified cars arrive, they can be flat switched directly onto an outbound departing train. Block swapping allows bypassing both the first and second sorting stage.

However, with multiple stage sorting, a new kind of preblocking opportunity presents itself: cars can be partially preblocked to bypass only the first sorting stage. This approach to yard operations is novel since it practically reverses the traditional direction of flow of cars through the yard. To see how it works, consider a system of three yards as shown in FIG. 2—two (or more) satellite yards; and a central hub yard which resorts all cars received, whether partially preclassified or not, for points beyond.

The hub yard must publish its plan for intermixing blocks on the same track in the first stage sort. Knowing ahead of time which blocks are combined, satellite yards can preclassify their cars to bypass the first stage sort at the hub. Cars need not be separated among blocks that are to be combined on the same track, so preblocking is based upon the track assignment at the hub yard. Trains prearranged in this manner can be flat switched upon arrival at the arrival/departure end. The cars end up in exactly the same placement in the classification tracks as if those trains had been humped. The whole train does not need to be preblocked—if only two or three tracks with the most cars were preclassified, it would still offer a considerable savings over having to process the entire train at the hump.

Figure 2:
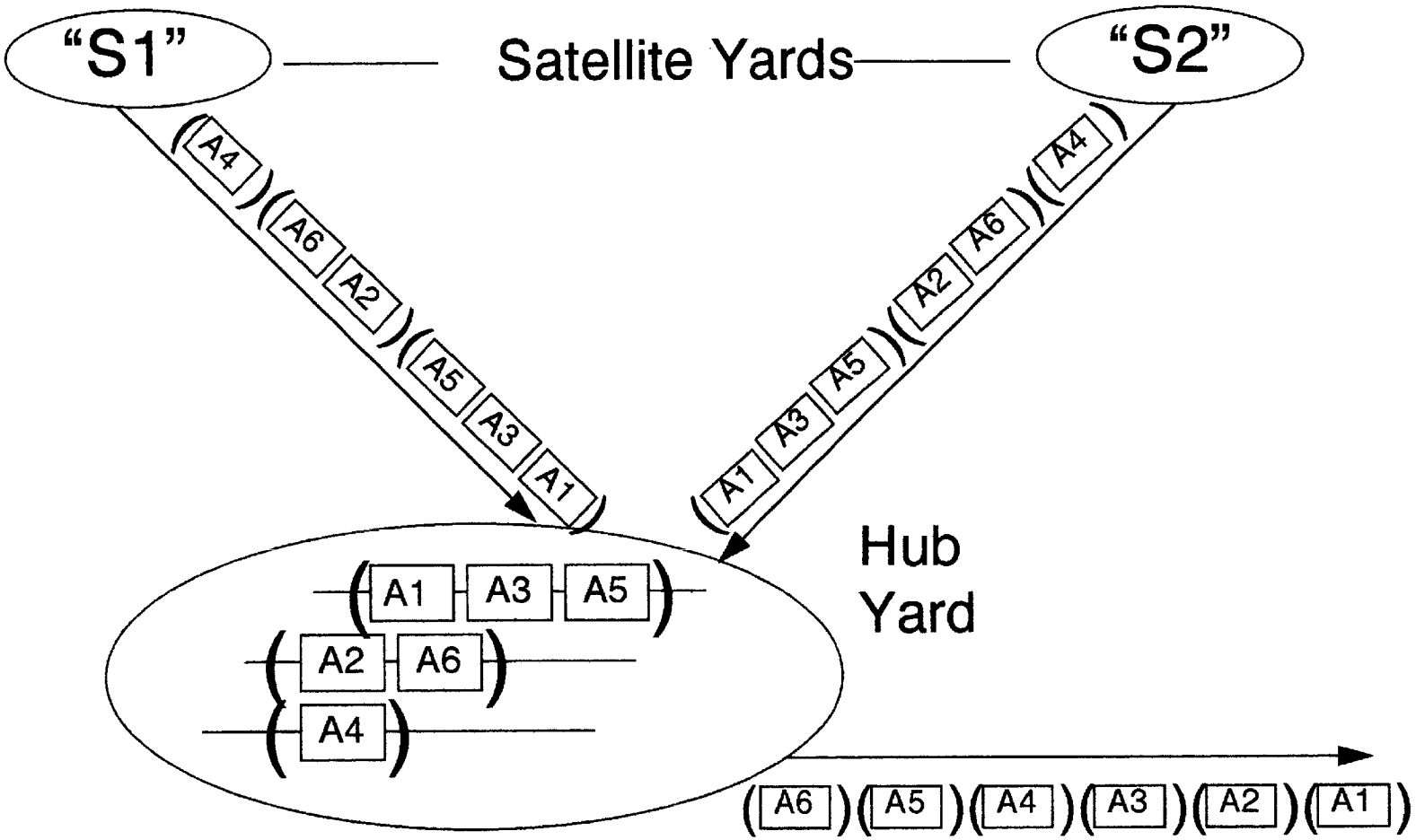
FIG. 2 shows a system of three yards—two satellite yards and a hub yard—where the satellite yards perform first stage switching for the hub.

FIG. 2 shows how partial preblocking can be used in conjunction with the triangular sorting pattern. The hub yard builds an outbound train of six distinct blocks, one thru six, in that sequence. As in the figures of the parent application, parentheses in FIG. 2 indicate intermixed groups of cars. Thus it can be seen that the outbound train consists of six distinct blocks in the proper order, and the cars are not intermixed between blocks.

Of course, those cars arriving at a yard are the same cars which eventually depart; the satellite yards see that blocks numbered 1,3 and 5 are intermixed on the same track at the hub yard; blocks 2 and 6 are intermixed on another track, while block 4 is on a track by itself (or possibly intermixed with cars for another train, not shown.)

Therefore each satellite yard builds a train of three blocks; intermixing cars for hub blocks 1,3 and 5; then 2 and 6; finally block 4 by itself. These two trains each arrive at the hub yard and are flat switched into the classification tracks from the arrival/departure end.

Once both trains have arrived and placed their cars, as described in the parent application a switch engine enters the classification tracks 55 (FIGS. 1 or 3) and pulls back the track containing the blocks 1,3 and 5 for hump processing. After the remaining two tracks have also been processed, the outbound train is complete on a single track ready for departure.

Note that this sequence is practically the opposite of what is practiced in conventional hump yards today. Conventional yards use the hump to process newly-arriving trains, but they rely on flat switching for train assembly. The process of partial preblocking reverses this. Newly arriving trains are flat switched into the classification tracks while the hump is used for final train assembly. The advantage of this process is that it becomes very easy to separate any unwanted, low priority cars in excess of train capacity at that hump just prior to departure. The significant benefit of being able to utilize otherwise-idle car time awaiting connections to perform mechanical inspection and repair is also preserved.

Partial preblocking can be justified in many cases where traffic volume would be insufficient to support a conventional bypass block. A practical rule of thumb is that a bypass block must have at least fifteen cars per day to be justified. To justify a block swap, each individual block must satisfy this minimum requirement of fifteen cars per day. But for partial preblocking, the decision is based on the combined volume of all blocks grouped together on the same track, not on volume of any individual block.

By reducing the proportion of hump time spent in first stage sorting, partial preblocking increases the productivity of the double hump leads. These double hump leads are really only useful during secondary sorting operations. During first stage sorting, only one train at a time can be humped since cars may be randomly sent to almost every track in the yard. But during secondary sorting, since cars are sent only into a limited number of tracks, both hump leads can work concurrently. This has a multiplier effect on capacity—for every car preblocked, capacity of the multiple stage yard is increased by an even greater amount. Effective use of partial preblocking can more than double the capacity of a multiple stage yard.

Use of partial preblocking does not limit the ability of the hub yard to assign blocks to tracks in any way desired—for example, the continuous sorting pattern proposed in the parent application can still be used. The steps required to implement a pattern of continuous sorting as disclosed in the parent application are unchanged, except for the added caveat that the first sorting stage may now be performed in a preceding yard.

Partial preblocking also does not interfere with removal of lower priority cars in excess of train capacity, since the second stage sort is still performed. In this respect, partial preblocking is superior even to block swapping, which affords no opportunity to adjust the consist of the cars being swapped or to remove low priority cars from that block The steps required to implement a priority-based sorting process as disclosed in the parent application are unchanged, except for the added caveat that the first sorting stage may now be performed in a preceding yard.

Finally, partial preblocking actually enhances the ability to inspect and repair cars while they lie in the classification tracks. Secondary sorting operations don't interfere with mechanical operations on tracks that are not receiving cars, so interruption to mechanical operations is limited to the length of time needed to flat-switch cars into each classification track. By decreasing the amount of first-stage sorting needed at the hump, the method of partial preblocking maximizes productivity of mechanical personnel in the yard by keeping interruptions to a minimum.

FIG. 3—Alternative Embodiment

An alternative embodiment consists of the yard of FIG. 3, operated by the method of partial preblocking of cars to bypass the first stage sort. In FIG. 3, a double hump lead with scizzors crossovers 140 has been added to the yard of FIG. 10 in the parent application, to allow parallel humping to proceed concurrently during the second stage sort. If adequate preblocking support can be provided, the yard of FIG. 3 could handle as much traffic as a large conventional single-stage yard, without needing the second sub-yard as shown in FIG. 1.

The best yard design for any given locale depends on the number of cars needing to be switched, land availability and cost, and the degree to which surrounding yards are able to provide preblocking support. However as a rule, the simplest design capable of providing the required capacity should be chosen. The more complicated design of FIG. 1 should be introduced only when the simpler yard of FIG. 3 is unable to handle the anticipated traffic volume.

Accordingly, a variety of means exist to increase capacity and boost efficiency of multiple stage classification yards. These include both physical improvements to the track design, as well as improved operating methods. In approximate order of priority, the following steps can be taken to increase the capacity of multiple stage switching yards:

(a) Provide a second hump switching lead, to allow parallel humping operations to proceed concurrently during second stage sorting. A second switching lead should always be provided as a standard feature of any multiple stage switching yard.

(b) Partially preblock cars at preceding yards so the first sorting stage can be bypassed Those cars can be flat switched at the arrival/departure end instead of having to be humped. Not only does this result in a direct reduction in the number of cars needing to be processed but actually increases the sorting capacity of the yard, since a higher proportion of the hump time is spent in second stage sorting where the dual hump leads can both be used.

(c) Provide a second subyard as shown in FIG. 1. In addition to doubling the number of hump switching leads, cars can be shoved directly to the hump of the opposite subyard eliminating the need for one pullback move. The second subyard also provides a limited capability to operate as a two stage folded yard.

This application shows that multiple stage switching on a large scale is feasible with conventional hump processing. Within the proven capabilities of conventional gravity switching, such yards can be configured to offer sorting capacity comparable to the largest of today's single stage yards. Although the description above contains many specificities, these should not be construed as limiting the scope of the invention, but as merely providing illustrations of some of the presently preferred embodiments of the invention. Thus the scope of the invention should be determined by the appended claims and their legal equivalents, rather than by the examples given.

What is claimed is:

1. A method of increasing the railway car handling capacity of multiple stage railway switching facilities by partially preblocking railway cars at more than one preceding yard to bypass a first stage sort at a central hub yard, comprising the steps of:

(a) determining which blocks will be intermixed on predetermined tracks at the central hub yard in the first stage sort, (b) publishing a plan for intermixing said blocks on said tracks, so said predecessor yards may be aware of which groups of cars are combined versus kept separate at the hub yard, and (c) at each said predecessor yard, separating cars into distinct groups based on the track assignment they will receive at the hub yard, whereby said distinct groups of cars are arranged into trains so said last-mentioned cars can be flat switched upon arrival directly into classification tracks at the hub yard, without needing to be classified at the hub yard by individual car in said first stage sort.

2. A method of sorting a plurality of railcars into a plurality of outbound trains on a plurality of tracks, comprising the steps of:

(a) initially arranging said railcars on a plurality of said tracks in a predetermined mathematical sorting pattern such that said railcars of more than one train or block may be intermixed on any single said track in a first stage sort, (b) offsetting and overlapping the mathematical sorting pattern of track assignments of said railcars for different trains or blocks in said first stage sort, for enabling the sorting method to be sustained on a continuous basis, (c) collecting said railcars on said tracks for an interval of time until a first outbound train must be readied for departure, (d) retrieving said railcars from said tracks in a predetermined sequence, and (e) rearranging said railcars on said tracks one or more additional times as required by the predetermined mathematical sorting pattern, such that said railcars are no longer intermixed but are separated into distinct trains which may have more than one block on a single track, whereby said railcars will be arranged into trains ordered in a proper block sequence for departure and the sorting method can be sustained on a continuous basis; and wherein said first stage sort may be performed at a preceding yard, so said railcars can be flat switched into classification tracks without having to be individually sorted.

3. A method of predetermining connections of specific railcars to specific outbound trains comprising the steps of:

(a) initially arranging said railcars on a plurality of tracks in a yard in a predetermined mathematical sorting pattern such that said railcars of more than one train or block may be intermixed on any single said track in a first stage sort, (b) collecting said railcars on said tracks for an interval of time until a first outbound train must be readied for departure, (c) retrieving said railcars from said tracks in a predetermined sequence, (d) rearranging said railcars on said tracks one or more additional times as required by the predetermined mathematical sorting pattern, such that said railcars are no longer intermixed but are separated into distinct trains which may have more than one block on a single track, and (e) removing from the train any of said railcars in excess of train capacity, or which are undesired by a customer during a second stage, third stage or later sort, whereby only preselected of said railcars are included in the train, and all other of said railcars are separated to remain in the yard or depart on a different train; and wherein said first stage sort may be performed at a preceding yard, so said railcars can be flat switched into classification tracks without having to be individually sorted.

4. A method of performing inspection and repairs of railcars, utilizing otherwise idle time of railcars while said railcars are awaiting outbound connections on tracks, comprising the steps of:

(a) initially arranging said railcars on a plurality of said tracks in a predetermined mathematical sorting pattern such that said railcars of more than one train or block may be intermixed on any single said track in a first stage sort, (b) collecting said railcars on said tracks for an interval of time until a first outbound train must be readied for departure, (c) retrieving said railcars from said tracks in a predetermined sequence, (d) rearranging said railcars on said tracks one or more additional times as required by the predetermined mathematical sorting pattern, such that said railcars are no longer intermixed but are separated into distinct trains which may have more than one block on a single track, and (e) during a second or later stage sorting operation, inspecting and repairing said railcars on tracks which are not receiving any other railcars during said second or later stage sorting operation;

whereby inspection and repairs of said railcars may be safely performed while the railcars lie on classification tracks; and wherein said first stage sort may be performed at any preceding yard, so said railcars can be flat switched into the classification tracks without having to be individually sorted.

5. A railcar sorting facility connected to a mainline, branch or secondary track, comprising two or more subyards, each subyard comprising:

a plurality of classification tracks onto which railcars can be sorted and stored until departure from said sorting facility, the lengths of each said classification tracks being substantially equal to a normal train length typically operated in the geographic territory in which said sorting facility is located;

at least one switching lead track and means for accelerating individual railcars or groups of railcars connected in operative relationship with each other and with said classification tracks for enabling acceleration of individual railcars, or groups of railcars onto said classification tracks while providing adequate separation between groups of railcars to allow for safe sorting operations;

a first plurality of track switches connected in operative relationship with said switching lead track or tracks and said classification tracks for routing said railcars, or groups of railcars, onto said classification tracks and for selecting which of said classification tracks will receive each of said railcars or group of railcars;

means in operative relationship with said classification tracks for decelerating said railcars, or groups of railcars, and for controlling their coupling speed within safe limits;

means in operative relationship with said classification tracks and with said mainline track for enabling arrival and departure of inbound and outbound trains directly from said classification tracks, and for enabling arriving trains to be received onto said classification tracks for storage while awaiting processing, whereby through application of multiple stage switching methods, trains of more than one block may be ordered in proper standing order sequence ready for departure on a single said classification track, eliminating the need for railcars to be switched into a separate set of departure tracks for final train assembly; and additional tracks connecting said subyards to allow trains received in designated tracks of one subyard to be processed in another subyard.

* * * * *